United States Patent [19]

Wilson

[11] 4,136,019

[45] Jan. 23, 1979

[54] PRODUCTION OF HIGH PURITY FLUORSPAR AND BARITE CONCENTRATES FROM A COMPLEX FLUORSPAR ORE

[75] Inventor: Martin Wilson, Anaheim, Calif.

[73] Assignee: United States Borax & Chemical Corp., Los Angeles, Calif.

[21] Appl. No.: 805,778

[22] Filed: Jun. 13, 1977

[51] Int. Cl.[2] ..... B03D 1/02

[52] U.S. Cl. ..... 209/166; 252/61

[58] Field of Search ..... 209/166, 162, 164, 9, 209/163; 252/61, 172; 210/44

[56] References Cited

U.S. PATENT DOCUMENTS

| | | | |
|---|---|---|---|
| 2,407,651 | 9/1946 | Clemmer | 209/166 |
| 2,412,217 | 12/1946 | Havens | 209/166 |
| 2,414,815 | 1/1947 | Kennedy | 209/166 X |
| 2,764,602 | 9/1956 | Ahlbrecht | 209/163 X |
| 2,788,362 | 4/1957 | Barnhart | 252/61 X |
| 3,186,546 | 6/1965 | Keen | 209/166 |
| 3,331,504 | 7/1967 | O'Connell | 209/172 X |
| 3,472,894 | 10/1969 | Bartlett | 252/61 X |
| 3,835,996 | 9/1974 | Singewald | 209/9 |

FOREIGN PATENT DOCUMENTS

| | | | |
|---|---|---|---|
| 165140 | 9/1963 | U.S.S.R. | 210/44 |

OTHER PUBLICATIONS

C. A., vol. 18, p. 92, 1974, 495845.

*Primary Examiner*—Robert Halper
*Attorney, Agent, or Firm*—James R. Thornton

[57] ABSTRACT

Beneficiation of complex non-sulfide ores such as fluorspar is effected by flotation using organic compounds containing the $CF_3$ group as selectivity agents.

14 Claims, No Drawings

PRODUCTION OF HIGH PURITY FLUORSPAR AND BARITE CONCENTRATES FROM A COMPLEX FLUORSPAR ORE

BACKGROUND OF THE INVENTION

The present invention is directed to the beneficiation of complex non-sulfide ores such as fluorspar ores using trifluoromethyl group-containing compounds as selectivity agents.

Fluorspar has wide and varied application in the chemical, ceramic, and metallurgical industries. Its uses range from a source of fluorine and hydrofluoric acid in chemical processes to that of a fluxing material in steel making. Commercial fluorspar, commonly referred to as "spar," is furnished to meet a number of varying specifications as to size and analysis. The fluorspar content of the commercial products ranges from a minimum of 85 percent in the case of "gravel spar" for steel making to a minimum of 97% fluorspar in the "acid grade" material for chemical processing. The specifications as to allowable impurities vary with the industry, but all industry requirements demand a fluorspar product relatively free of silica, calcium carbonate, barite, and sulfides such as galena, sphalerite, or pyrite. Fluorspar ores as mined seldom meet commercial specifications, either with regard to fluorspar content or freedom from impurities, and suitable methods of concentration, such as froth flotation, must therefore be employed to recover commercial products from the low grade or contaminated ores.

Geographically, fluorspar is widely distributed in minute quantities, but deposits of commercial value in the United States are not numerous. Fluorspar deposits occur in both igneous and sedimentary rocks, as veins following faults, fissures or shear zones; as horizontal or bedding replacement deposits in sedimentary rocks; or as incrustations in vugs and caves. Sizable deposits of fluorspar are known in the western states including California, Arizona, New Mexico, Nevada, Texas and Colorado. The vein and bedded deposits in the Illinois–Kentucky area are reputed to be among the largest in the world. The improved process of froth flotation of the present invention can be used for the beneficiation of ores from various localities.

The gangue minerals commonly found associated with fluorspar in commercial deposits are quartz, calcite and barite. Other accessory minerals may include sulfides such as galena, sphalerite, pyrite or chalcopyrite; or oxidized lead and zinc minerals such as cerussite and smithsonite. Common gangue constituents of fluorspar ores are limestone and clay, and many ores also contain shale and sandstone. Ores from different deposits, or from different portions of the same deposit, may show considerable variation both with regard to mineral association and relative proportions of fluorspar and other minerals. In the Illinois–Kentucky fluorspar district, for example, the ore from a particular deposit may be devoid of barite, whereas the ore from an adjacent deposit may contain ten percent or more of barite. Similarly, the galena or sphalerite contents may also show considerable variation. Ore from a particular mine location may contain minute quantities of galena or sphalerite, whereas ore from another part of the mine often contains sufficient galena or sphalerite to justify their recovery as valuable by-products in fluorspar milling. The lime and silica contents of fluorspar ores may likewise show considerable variation. Uniform deposits of fluorspar are an exception rather than the rule, and milling methods must be sufficiently flexible to permit treatment of a variety of ores of different grades and mineral association. An important object of this invention is to provide a flotation method applicable to a variety of ores of different grades and mineral association for recovery of the fluorspar and barite concentrates from associated gangue materials.

Barite, or barium sulfate, is often found in the fluorspar ores, and is the chief source of barium chemicals. Unground crude barite is used for the production of lithopone and barium chemicals. Ground barite, which is sold in numerous sizes and degrees of purity, is used in oil well drilling mud; glass making; as a filler for paper, rubber, oilcloth, linoleum, etc.; paint pigments; X-ray apparatus; storage batteries; and brass smelting.

It is known to use fatty acid and related sulfates and soaps as collection reagents to float fluorspar; however, the separation has been difficult because the fatty acid-type collectors for fluorspar are non-selective and tend to float everything, with the exception of the silica.

It is well known in the art that the sphalerite may be activated with copper sulfate and the sulfides floated with xanthates or dithiophosphates. The slurry, free of sulfides, is then ready for the fluorspar flotation. In order to float the fluorspar with fatty acids, the carbonates and the barite must first be depressed. Methods have been developed in the past to depress the carbonates and the barites by the addition of quebracho, or ligninsulfonate, at a pH between 9 and 10. This treatment, in the case of complex ores, was only partially successful. To enhance a better and cleaner separation, sodium fluoride was added to the flotation medium (U.S. Pat. No. 2,407,641, to Clemmer et al). Later, chromates and dichromates were used to keep the barite down during the fluorspar flotation. Although sodium fluoride increased selectivity in the flotation considerably, sodium fluoride is a poisonous and relatively expensive additive. The use of chromates and dichromates, on the other hand, creates a serious environmental problem from the chromium ion.

SUMMARY OF THE INVENTION

It has now been discovered that the froth flotation of non-sulfide ores such as fluorspar and barite can be improved by using aliphatic or aromatic compounds containing the $CF_3$ group.

It is postulated that the above-described interference of the fluorspar flotation is the result of calcium ions in solution. Although the concentration of calcium ions in a carbonate solution is relatively low, there are still enough calcium ions in solution to form calcium salts with the fatty acids or soaps used as fluorspar collectors. These calcium salts of fatty acids form a scum which smears indiscriminately over any surface. Thus, a particle containing such a contaminated surface will float. However, when the $CF_3$-containing compound is added prior to the addition of fatty acid or soap, less soluble calcium complexes or salts are formed, decreasing the number of calcium ions remaining in the slurry, and resulting in a cleaner separation.

Useful $CF_3$ group containing compounds according to this invention are the aliphatic and aromatic compounds having at least one $CF_3$ group. Such compounds may be liquid or solids and preferably should be somewhat soluble or dispersable in the aqueous slurry of ore. Examples of such compounds include benzotrifluoride and its substituted derivatives such as those having halo, nitro, amino, hydroxy, lower alkoxy, carboxyl, carboxamide, carbonyl, and lower alkyl substituents. The aliphatic $CF_3$-containing compounds may also be used, including the fluorinated alkyls which have additional groups such as the hydroxy, sulfonic acid, carboxylic acid, amino, lower alkoxy and nitro groups. Representative examples of such compounds are 2-chlorobenzotrifluoride
2-amino-4-nitrobenzotrifluoride
m-trifluoromethylacetanilide
2-methylbenzotrifluoride
3-methylbenzotrifluoride
2-trifluoromethyl-4-nitroanisole
4-chlorobenzotrifluoride
2-aminobenzotrifluoride
o-trifluoromethylacetophenone
2-hydroxybenzotrifluoride
2,4-diamino-3,5-dinitrobenzotrifluoride
4-trifluoromethylbenzoic acid
trifluoroacetic acid
2-trifluoroethanol
2-trifluoroethanesulfonic acid
trifloroacetylacetone
3-trifluoromethylpropylamine
fluorinated alkanes containing an average of 7–8 fluorinated carbons and additional ionic groups such as the ZONYL fluorosurfactants.

The $CF_3$-containing compounds are added prior to or with the fatty acid or soap collection reagents. They may be added as such if they are liquids or they may be dissolved in the fatty acid or a suitable solvent such as the alcohols or glycol ethers.

Suitable concentrations of the $CF_3$ selectively reagents range from about 0.001 to 0.5 pound of reagent per ton of flotation feed. Preferably, from about 0.01 to 0.1 pound is used.

DETAILED DESCRIPTION OF THE INVENTION

The ore used in all of the following examples came from Sweetwater, Tennessee. The ore had been upgraded by a conventional heavy medium separation process to 36.4% calcium fluoride, 14.3% barium sulfate and 0.22% zinc sulfide. The ore was crushed in a ball mill to about 15% +100 mesh.

All flotations were conducted according to the following basic conventional flotation procedure.

Sulfides were floated in the conventional manner, and the sulfide rougher tailings were settled and decanted. The settled solids, at 50% to 60% pulp density, were reagentized at 45° C. by adding 4 pounds per ton of feed of sodium carbonate as well as 4 pounds of lignin sulfonate per ton of feed. The fatty acid was then added, generally, for the ore used, at a level of about 0.75 pounds of fatty acid per ton of feed.

The make up water contained approximately 120 ppm. dissolved solids. The rougher concentrate was cleaned twice. All flotations were conducted in a 3000 ml. Denver flotation cell with stirrer speed of between 1200 rpm. and 1500 rpm. The original charge of the rougher float consisted of 500 g. of ore (15% +100 mesh) in a slurry of about 20% solids.

EXAMPLE 1

This example presents the results of a control test conducted without any selectivity agent.

Table I

| | Wt., g. | Wt. % | $CaF_2$ % Grade | $CaF_2$ % Distribution | $BaSO_4$ % Grade | $BaSO_4$ Distribution |
|---|---|---|---|---|---|---|
| Sulfide Rougher Concentrate | 23.2 | 5.0 | 16.4 | 2.2 | 10.0 | 3.1 |
| $CaF_2$ Recleaner Concentrate | 157.0 | 33.8 | 92.6 | 83.8 | 2.7 | 5.8 |
| $CaF_2$ Rougher and Cleaner Tailings Decantate | 8.8 | 1.9 | 11.2 | 0.6 | 14.5 | 1.7 |
| $CaF_2$ Recleaner Tails | 18.8 | 4.0 | 26.1 | 2.8 | 34.6 | 8.8 |
| $CaF_2$ Rougher and Cleaner Tailings (Settled Solids) | 256.9 | 55.3 | 7.2 | 10.6 | 21.9 | 80.6 |

The fluorspar recleaner concentrate is of low purity (92.6%), with a relatively high barite content (2.7%).

A similar test was conducted using water containing 410 ppm. dissolved solids. The purity of this product was low, with only 94.2% calcium fluoride and a high percentage of barite (3.2%).

EXAMPLES 2–9

The procedure was the same as described above except for the addition of various $CF_3$-containing compounds as selectivity agents.

The 2,4-diamino-3,5-dinitrobenzotrifluoride reagent was dissolved in monoglyme (5% solution) and added prior to the fatty acid. In all the other tests, the selectivity reagents were dissolved in the fatty acid, PAMAK-4, and added at the conditioner. PAMAK-4 is described as primarily oleic and linoleic acids derived from tall oil. ZONYL FSA and FSC are described as aliphatic compounds having an average of 7–8 fluorinated carbons. ZONYL FSA is anionic and ZONYL FSC is cationic. Both are sold as a 50% solution in isopropanol-water.

Table II shows the results of the tests using examples of organic $CF_3$ selectivity reagents of the present invention, as well as nitrobenzene as a control to determine if the $CF_3$ group is necessary to provide effective selectivity for fluorspar flotation.

Table II

| | Selectivity Agent | | PAMAK 4 | Calcium Fluoride Concentrate | | |
|---|---|---|---|---|---|---|
| Example | Compound | lb./ton | (lb./ton) | $CaF_2$ Grade % | $CaF_2$ Recovery (%) | BaSO Grade[4] (%) |
| 2 | 2,4-diamino-3,5-dinitro-benzotrifluoride | 0.25 | 1.0 | 98.0 | 93.0 | 0.4 |
| 3 | 2,4-diamino-3,5-dinitro-benzotrifluoride | 0.005 | 1.0 | 98.3 | 93.2 | 0.6 |
| 4 | 2,4-diamino-3,5-dinitro-benzotrifluoride | 0.023 | 1.0 | 98.2 | 92.3 | — |
| 5 | ortho-chloro- | | | | | |

Table II-continued

| Example | Selectivity Agent Compound | lb./ton | PAMAK 4 (lb./ton) | Calcium Fluoride Concentrate $CaF_2$ Grade % | $CaF_2$ Recovery (%) | BaSO Grade[4] (%) |
|---|---|---|---|---|---|---|
| | benzotrifluoride | 0.05 | 1.0 | 100.0 | — | 0.15 |
| 6 | 2-amino-4-nitro-benzotrifluoride | 0.05 | 1.0 | 97.1 | — | 0.16 |
| 7 | benzotrifluoride | 0.04 | 0.75 | 98.2 | 91.5 | 0.2 |
| 8 | 4-chlorobenzotrifluoride | 0.08 | 0.68 | 98.2 | 91.7 | 0.3 |
| 9 | trifluoroethanol | 0.03 | 0.62 | 99.4 | 92.6 | 0.3 |
| 10 | trifluoroacetic acid | 0.03 | 0.64 | 94.6 | 91.5 | 0.4 |
| 11 | ZONYL FSA (50%) | 0.06 | 0.72 | 97.5 | 92.1 | 0.2 |
| 12 | ZONYL FSC (50%) | 0.06 | 0.72 | 98.5 | 94.0 | — |
| 13 | nitrobenzene | 0.1 | 1.0 | 88.0 | 95.8 | 4.5 |

It can be seen from the above that the use of organic compounds containing the $CF_3$ group increases the purity of fluorspar flotation concentrates from fluorspar ores, especially from fluorspar-barite ore.

In the case of 2,4-diamino-3,5-dinitrobenzotrifluoride, which acts as a dye, the fluorspar concentrate shows a bright, canary yellow color which indicates the affinity of the benzotrifluoride derivative for the calcium in calcium fluoride. The $CF_3$-containing compounds do not interact with the calcium in the dolomite and calcite because the surfaces of these latter compounds are protected by the lignin sulfonate from the calcium fluoride flotation, which is added to depress the carbonaceous gangue.

Although the fluorspar flotation was improved, the barite flotation from the calcium fluorite tailings was erratic. However, if the previous assumption of an interaction of the $CF_3$-containing compound with the calcium ions is correct, and the calcium ions are interfering with the barite flotation, an improvement of the barite flotation should also be achieved by the addition of a $CF_3$ compound. Conventionally, deionized water is used in the flotation of barite. If the above-described reaction is to take place and the calcium ion concentration in the liquors is to be decreased, the liquors should approach the state of deionized water. The barite flotation should then proceed without difficulty, i.e., without encountering excess reagent consumption, unmanageable froth inconsistencies, and low grade concentrates. In effect, the addition of the $CF_3$-containing compound to the barite slurry transfers barite flotation into a reliable process with reproducible results.

A standard test was developed for the barite flotation. The ore used was the same as that used for the fluorspar flotation. The calcium fluoride rougher and cleaner tailings were decanted. The settled solids, containing about 22% barium sulfate, representing 90 to 95% of the barite originally contained in the ore were diluted to about 10% solids with water containing 120 ppm. dissolved solids. The reagentizing was conducted in a 3000 ml. Denver cell. The pH was adjusted to about 10 with 5% sodium carbonate solution. Five ml. of 5% barium chloride solution were added to activate the barite. Then one pound of Stepanflote 24 (30% cetyl sulfate in water) per ton of feed was added as a 2.5% solution. The rougher concentrate was returned to the cell for cleaning and the cleaner concentrate returned for a second cleaning.

Examples 14 through 17, tabulated in Table III below, show results of barite floats carried out in non-deionized water and without the addition of the $CF_3$-containing compounds. Use of deionized water is accepted plant practice, because if non-deionized water is used, the flotation loses its selectivity, the froth becomes unmanageable, and reagent consumption becomes excessive. Example 18 shows the result of a barite float carried out in deionized water.

Table III

| Example | Water Hardness (ppm) | Selectivity Agent (lb./ton of flotation feed) | | $BaCl_2$ (lb./ton of flotation feed) | Stepanflote 24 (lb./ton of flotation feed) | Barite Concentrate $BaSO_4$ Grade (%) | $BaSO_4$ Recovery | $CaF_2$ Grade (%) |
|---|---|---|---|---|---|---|---|---|
| 14 | 410 | Cataflot 40* | 0.5 | 1 | 2.25 | 78.9 | 85 | 3.3 |
| 15 | 410 | Quebracho | 0.4 | 1 | 2.0 | 77.8 | 57 | — |
| 16 | 410 | — | — | 1 | 4.0 | 80.0 | 88 | 1.1 |
| 17 | 120 | Quebracho | 0.5 | 1 | 1.5 | 88.3 | — | 1.9 |
| 18 | 0 | — | — | 1 | 1.0 | 96 | 84 | 2.7 |

*product of Pierrefitte - Aubrey Co., France - a very low molecular weight acrylic polymer especially developed for depressing and dispersing calcareous and dolomitic gangue in ore flotation These examples illustrate the erratic results obtained in barite flotation in hard water. Obviously, the flotation is unreliable. However, as can be seen from Example 18, if deionized water is used, the flotation proceeds without difficulty.

It has now been discovered that equally good results can be obtained with hard water by the addition of an organic compound containing the $CF_3$ group. The method is reliable, and is obviously much cheaper than the deionization of water.

Examples 19 through 29, the results of which are shown in Table IV, illustrate the use of the $CF_3$-containing compounds in hard water for barite flotation. The $CF_3$ compounds were added directly to the ore slurry prior to addition of the cetyl sulfate reagent.

Table IV

| Example | Water Hardness (ppm) | Selectivity Agent Compound | lb./ton feed | Cleaning Steps | $BaCl_2$ (lb./ton) | Stepanflote 24 (lb/ton feed) | Barite Concentrate $BaSO_4$ Grade (%) | $BaSO_4$ Recovery (%) | $CaF_2$ Grade (%) |
|---|---|---|---|---|---|---|---|---|---|
| 19 | 120 | Benzotri-fluoride | 0.05 | 1 | 1.0 | 1.0 | 93.6 | 87 | 4.4 |

Table IV-continued

| Example | Water Hardness (ppm) | Selectivity Agent Compound | Selectivity Agent lb./ton feed | Cleaning Steps | $BaCl_2$ (lb./ton) | Stepanflote 24 (lb/ton feed) | Barite Concentrate $BaSO_4$ Grade (%) | Barite Concentrate $BaSO_4$ Recovery (%) | Barite Concentrate $CaF_2$ Grade (%) |
|---|---|---|---|---|---|---|---|---|---|
| 20 | 120 | " | 0.07 | 2 | 1.0 | 1.0 | 97.8 | 81.8 | 1.7 |
| 21 | 120 | " | 0.1 | 2 | 1.0 | 1.0 | 97.6 | | |
| 22 | 120 | 4-chlorobenzo-trifluoride | 0.08 | 2 | 1.0 | 1.0 | 96.5 | 79.7 | 2.5 |
| 23 | 120 | o-trifluoro-methylphenol | 0.05 | 2 | 1.0 | 1.0 | 97.3 | 83.5 | 2.4 |
| 24 | 120 | 2-aminobenzo-trifluoride | 0.05 | 2 | 1.0 | 1.0 | 97.5 | | 1.1 |
| 25 | 120 | trifluoroeth-anol | 0.06 | 2 | 1.0 | 1.0 | 97.3 | 79.5 | 1.7 |
| 26 | 120 | trifluoroacetic acid | 0.04 | 2 | 1.0 | 1.0 | 94.6 | 82.9 | 2.5 |
| 27 | 120 | ZONYL FSA | 0.06 | 2 | 1.0 | 1.0 | 94.8 | 87.0 | 2.3 |
| 28 | 120 | ZONYL FSC | 0.05 | 2 | 1.0 | 1.0 | 97.4 | 73.0 | 1.2 |
| 29 | 120 | ZONYL FSC | 0.05 | 2 | 1.0 | 1.0 | 93.6 | 81.7 | 1.0 |

The $CF_3$ group appears to have an affinity for the calcium in the barite liquors, so the water in the barite circuit would then approach the performance of deionized water. It can be seen from Table IV that the $CF_3$-containing compounds did, in fact, transform the barite flotation into an easy and reliable operation without using deionized water. The froth remainded normal, and in consecutive tests, good barite concentrates were produced.

In conclusion, it has been shown in the above that fluorspar can be floated to acid grade (97%) by using the $CF_3$-containing compounds as selectivity agents. Most advantageously, most of these compounds can be dissolved in the fatty acids which serve as collectors for the fluorspar.

Barite is generally floated with cetyl sulfate, a fatty acid derivative. Since cetyl sulfate does not dissolve many of the $CF_3$ derivatives, those that are liquids can be most conveniently added directly to the barite flotation. When used herein, fatty acid-type collection reagents are meant to include the well known fatty acids, soaps and fatty acid derivatives such as the sulfates which are used in froth flotations.

The use of the $CF_3$-containing compounds is applicable to the froth flotation of other non-sulfide or refractory ores in which soluble calcium ions may be present and act to interfere with the clean separation of the desired products. Such ores include chromite, cassiterite, cerussite, scheelite, smithsonite, rutile, malachite, azurite, phosphates, iron ores, etc.

Various changes and modifications of the invention can be made, and, to the extent that such variations incoporate the spirit of this invention, they are intended to be included within the scope of the appended claims.

What is claimed is:

1. The method of beneficiating non-sulfide ores comprising subjecting an aqueous slurry of said ore to froth flotation in the presence of a fatty acid-type collector reagent and an organic $CF_3$-group containing compound selectivity agent, thereby depressing interfering calcium ions.

2. The method of claim 1 wherein the selectivity agent is present in the amount of from about 0.001 pound to about 0.5 pound of selectivity agent per ton of flotation feed.

3. The method of claim 1 wherein the selectivity agent is benzotrifluoride.

4. The method of claim 1 wherein the selectivity agent is 2-chlorobenzotrifluoride.

5. The method of claim 1 wherein the selectivity agent is 2-trifluoroethanol.

6. The method of claim 1 wherein the selectivity agent is 2,4-diamino-3,5-dinitrobenzotrifluoride.

7. The method of claim 1 wherein said ore is barite.

8. The method of claim 1 wherein said ore is fluorspar.

9. In the method of froth flotation of non-sulfide ores in the presence of interfering calcium ions by means of fatty acid-type collection reagents, the improvement which consists of adding a selectivity agent consisting of an organic compound containing the $CF_3$ group prior to or simultaneously with the addition of said fatty acid-type collection reagent.

10. The method of claim 9 wherein the selectivity agent is 2,4-diamino-3,5-dinitrobenzotrifluoride.

11. The method of claim 9 wherein the selectivity agent is benzotrifluoride.

12. The method of claim 9 wherein from about 0.001 to about 0.5 pound of said selectivity agent is added per ton of flotation feed.

13. The method of claim 9 wherein about 0.01 to 0.1 pound of said selectivity agent is added per ton of flotation feed.

14. The method of beneficiating fluorspar ore comprising subjecting an aqueous slurry of said ore to froth flotation in the presence of an organic $CF_3$-group containing compound selectivity agent dissolved in a fatty acid fluorspar collector reagent, thereby depressing interfering calcium ions.

* * * * *